United States Patent [19]

Peterson et al.

[11] 4,301,609

[45] Nov. 24, 1981

[54] TRIGGER ASSEMBLY FOR BOLT ACTION PISTOLS

[75] Inventors: Ronald W. Peterson, Westminster; Fred Jennie, Anaheim Hills, both of Calif.

[73] Assignee: Weatherby, Inc., South Gate, Calif.

[21] Appl. No.: 57,408

[22] Filed: Jul. 13, 1979

[51] Int. Cl.[3] ..... F41C 19/00
[52] U.S. Cl. ..... 42/69 A
[58] Field of Search ..... 42/69 A, 69 B, 69 R

[56] References Cited

U.S. PATENT DOCUMENTS

| | | | |
|---|---|---|---|
| 1,068,752 | 7/1913 | Febiger | 42/69 A |
| 1,693,530 | 11/1928 | Spencer | 42/69 A |
| 2,249,231 | 7/1941 | Smith | 42/69 A |
| 3,013,355 | 12/1961 | Weatherby | 42/69 A |

*Primary Examiner*—Charles T. Jordan
*Attorney, Agent, or Firm*—Herzig & Walsh, Inc.

[57] ABSTRACT

A bolt action hand gun, that is, pistol, having its balance point over the hand. The trigger is in a forward position on the action with an improved connection between the trigger and the sear. The improved connection is such as to prevent accidental firing when the pistol is dropped on the muzzle or butt.

11 Claims, 4 Drawing Figures

TRIGGER ASSEMBLY FOR BOLT ACTION PISTOLS

BACKGROUND OF THE INVENTION

1. Field of the Invention

The field of the invention is broadly firearms, and more especially, the field is that of hand guns, particularly pistols.

2. Description of the Prior Art

Having reference to the prior art, in known bolt action firearms there is not a teaching of a pistol which is balanced, having the center of gravity over, or nearly over the hand and also embodying appropriate safety features, such as particularly drop-safe features. In known bolt action pistols, there is used a pull rod between the upper part of the trigger and the sear release to pull the sear release out from supporting the sear. If a pistol of this construction is dropped on its muzzle, the pull rod moves forward under the influence of inertia and fires the pistol unless some safety device is built in. This drawback or deficiency is characteristic of the prior art among others, all of which are overcome by the invention as described in detail hereinafter.

Known prior art patents include German Pat. No. 501,265; U.S. Pat. Nos. 1,047,671; 2,090,656; 3,088,378; 3,577,668; 3,755,991; 3,950,876; and 4,132,023.

German Pat. No. 501,265 appears to show a link in between the trigger and the sear, and U.S. Pat. No. 1,047,671 appears to show a connector between the trigger and the sear. These patents are otherwise considered not relevant.

U.S. Pat. No. 2,090,656 appears to show a rather complex assembly, including a set lever and a sear lever, and appears otherwise not to be relevant.

U.S. Pat. No. 3,088,378 appears to show a sear link actuated by the trigger but does not appear to be otherwise relevant. The other U.S. patents identified are considered not to be relevant.

SUMMARY OF THE INVENTION

An improved exemplary form of the invention is described in detail hereinafter.

In the exemplary form of the invention, the trigger itself is in a forward position relative to the trigger mechanism which is at the rear of the action, that is, near the rear of the receiver, so that the balance point is over, or nearly over the hand. A pivoted connector is provided between the trigger and a sear release member. Release of the sear actuates the cocking piece, allowing the firing pin to strike the primer.

With respect to the herein invention, the connector or link between the trigger and the sear release is pivoted, there being no part that can move forward by inertia such as to cause the pistol to fire in the event of dropping it on its muzzle. A separate safety device to preclude this type of accident is not necessary.

The mechanism is safe if the pistol is dropped on its muzzle or on its butt, or if the pistol is placed on a resting surface with too much force when aiming at a target. A sear release member which is pivoted is proportioned such that the greater part of its mass is behind the pivoted end. If the pistol is dropped on its butt, inertia causes the sear release to be rotated into the sear, preventing the sear from being cammed down by the cooking piece. The sear spring is supported between the sear and the sear release and acts on both to push them into a safe position, and it adds its mass to that of the sear release to be rotated into the safe position.

In accordance with the foregoing, a primary object of the invention is to make available a hand gun, that is, a pistol, which is balanced, having the center of gravity over, or nearly over the hand, the trigger being in a forward position, with improved connecting means between the trigger and the sear, providing drop-safe features.

A further object is to realize drop-safe features in a gun as identified in the foregoing wherein a pivoted actuating link is provided between the trigger and sear release member whereby accidental firing cannot result from dropping the pistol on its muzzle.

A further object is to realize a safety feature in that dropping the pistol on the butt or exerting pressure on the butt will not result in accidental firing, this feature being realized by way of a pivoted sear release member proportioned so that, if the sear release is activated by inertia, it moves in a direction into the sear, preventing the sear from being actuated to fire.

Further objects and additional advantages of the invention will become apparent from the following detailed description and annexed drawings.

DESCRIPTION OF THE PREFERRED EMBODIMENT AND BEST MODE OF PRACTICE OF THE INVENTION

Figure 1:
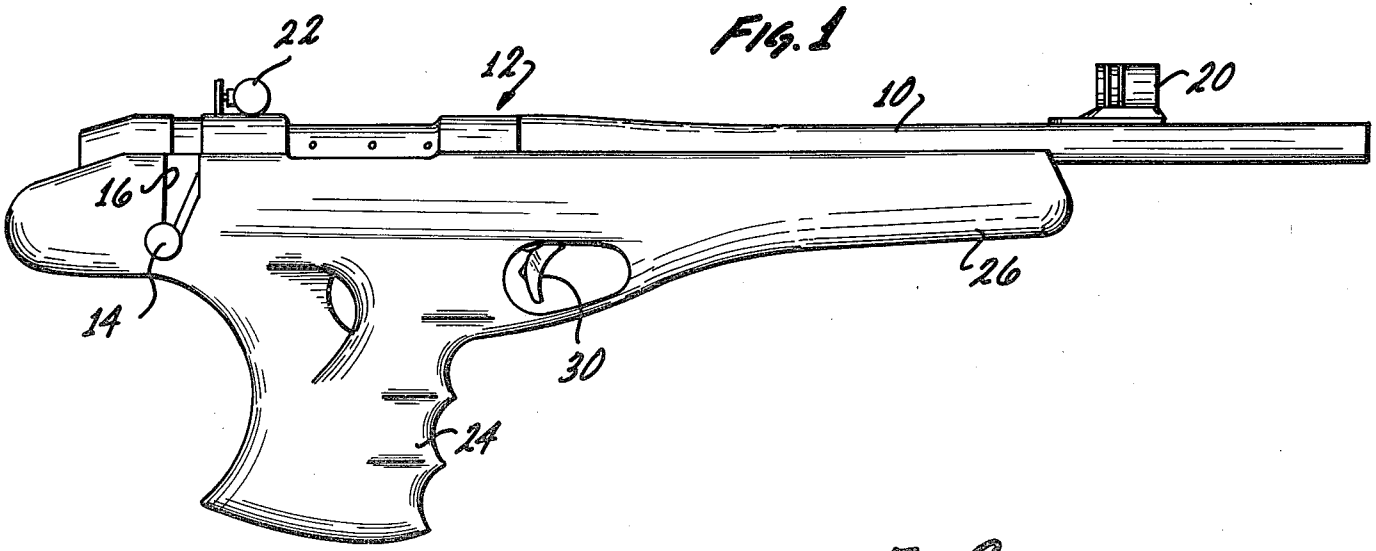
FIG. 1 is an elevational view of a preferred form of the invention.

In FIG. 1, a bolt action firearm is shown which is a hand gun, more particularly, a pistol, having a barrel 10 and bolt action receiver or bolt body, as designated at 12, having a bolt handle 14 operating in slot 16. Numeral 20 designates the front sight on the barrel, and numeral 22 designates the rear sight.

Numeral 24 designates the grip portion of the stock, the center of gravity of the pistol being over, or nearly over the grip. The stock includes the upper part 26 in which the barrel and receiver are fitted. The stock may be made of any suitable material, including wood, plastic, or composition. The trigger is designated at 30.

Figure 2:
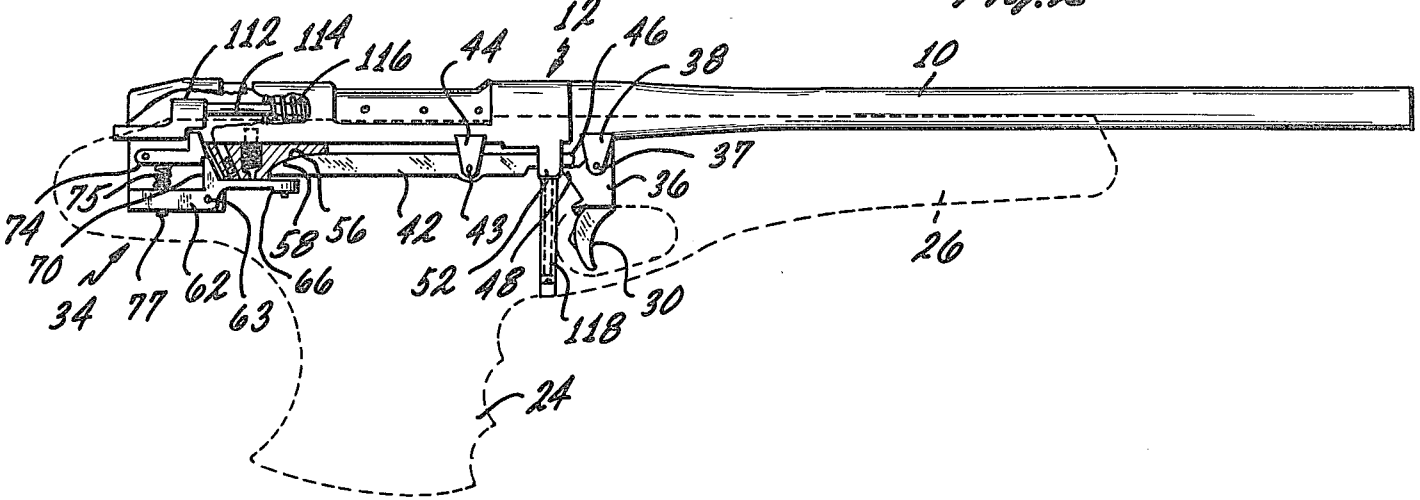
FIG. 2 is a view similar to FIG. 1 showing details of the trigger mechanism.

The trigger and associated mechanism is designated generally by the numeral 34 in FIG. 2, which illustrates its position at the rear of the bolt action mechanism.

Figure 3:
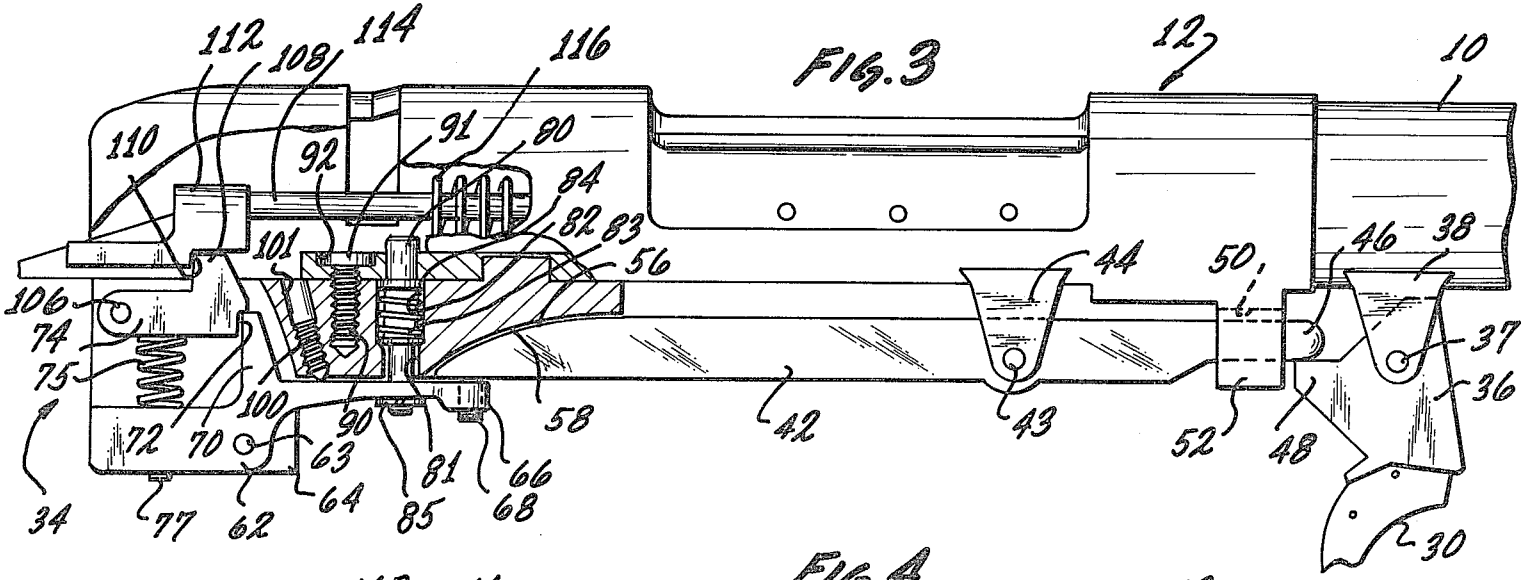
FIG. 3 is an enlarged view showing details of the trigger mechanism with the mechanism in one position.
Figure 4:
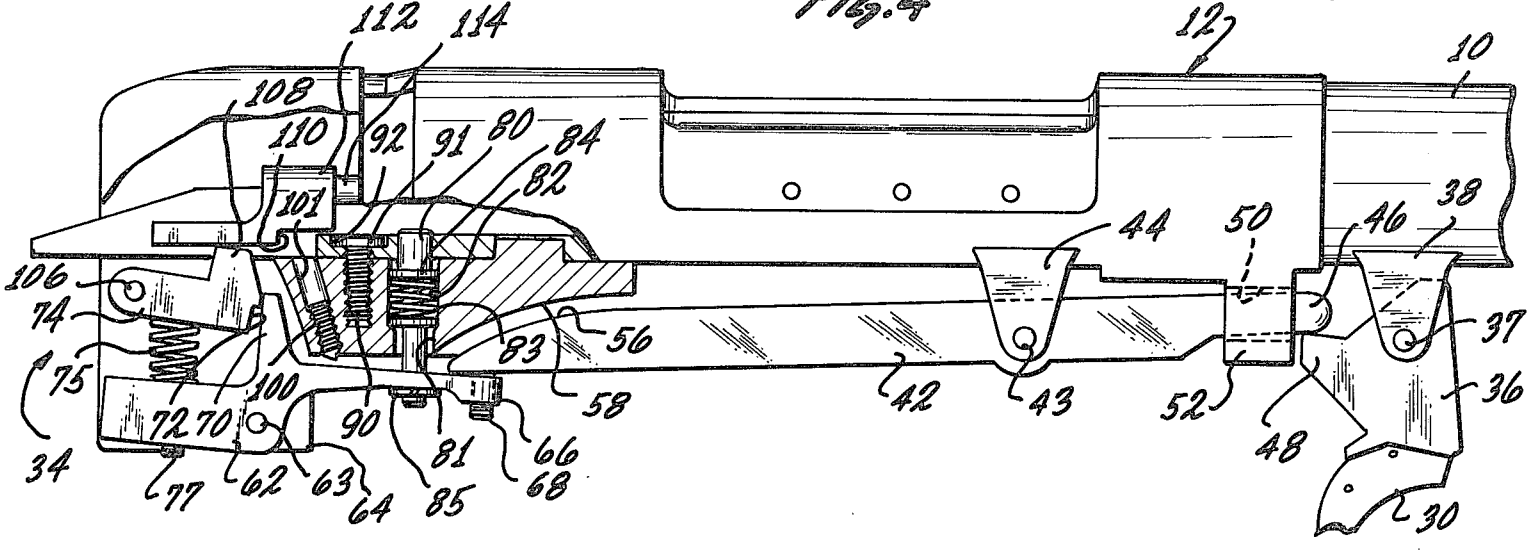
FIG. 4 is a view similar to FIG. 3 showing the trigger mechanism in another position.

FIGS. 3 and 4 are enlarged views illustrating the details of the trigger mechanism 34.

The trigger 30 is carried by trigger piece 36, which is pivoted on pivot pin 37 journalled between the legs of yoke 38 underneath the barrel 10. The trigger and trigger piece may also be made in one integral piece. Numeral 42 designates the connector or link which is between the trigger and the sear release as will be described. The connector is pivoted on a pivot pin 43 journalled in yoke 44, underneath the receiver 12. The link 42 has a narrowed end part 46 engageable by toe or lug 48 on the trigger piece 36. The end part 46 can move up and down in an opening 50 in a downwardly depending part (recoil lug) 52 extending down from the receiver 12.

At the end of the link 42, it has a curved upper surface 56 contoured to be contiguous to a complementary curved surface 58 on the lower side of the action, as shown.

Numeral 62 designates the sear release which has a shape as shown and which is pivoted on a pivot pin 63 extending between side wings or parts of the action, one of which is designated at 64. The sear release has a forwardly extending part as designated at 66 which is adjacent to the under side of the action, and its end is adjacent to the end of the link 42, as shown. This end part carries a trigger takeup screw 68 which engages the end of the link 42. The sear release has an upwardly extending finger 70 which cooperates with a notch 72 in the sear 74, the notch providing a shoulder which the finger 70 can engage for holding the sear. The greater part of the mass of sear release 62 is rearward of pivot 63.

Numeral 80 designates the bolt release pin or plunger which releases by continued pulling of the trigger. The sear release 62 can be caused to pull down the bolt release plunger 80. It extends through bore 81 having a counter bore 82, in which is a biasing spring 83, which acts on a collar 84 on the bolt release plunger 80. The pin 80 is secured by a washer 85 at its lower end.

The lower part of the trigger action is secured to the upper part by a screw 90 having a head 91 seated in a counter sink 92.

Numeral 100 designates a creep adjustment screw positioned in a threaded slant bore 101, the end of the screw bearing on the end part 66 of the sear release 62.

The sear 74 is pivoted on a member 106 extending between the side wings of the action, as shown. The sear is in the form of a bell crank lever having an upper lever or hook part 108 forming a square toe that cooperates with a notch 110 formed in cocking piece 112 to which is attached the firing pin 114. The firing pin spring is shown at 116.

In between the sear release 62 and the sear 74 is the sear spring 75. Numeral 77 designates the trigger pull adjustment screw. The screw is screwed in to increase the weight of pull and out to decrease it. The action is secured to the stock part by way of tang screws, one of which is shown at 118 in FIG. 2.

OPERATION

FIG. 3 shows the position of the parts before firing, and FIG. 4 shows the position of the parts after pulling the trigger and firing. When the trigger 30 is pulled, this pivots the trigger piece 36 about its pivot, lifting the front end of the connector or link 42, that is, moving it about its pivot a small amount. As it pivots, its rear end moves downwardly, pressing downwardly on the end of the arm 66 of the sear release 62, pivoting the sear release about its pivot 63. When this happens, the finger or part 70 of the sear release 62 disengages from the notch 72 of the sear 74 so that the sear can disengage from the cocking piece 112 at the end of the firing pin 114. Under the influence of the firing pin spring 116, the cocking piece 112 is pressing forward on the vertical face of the upper part 108 of the sear 74, causing the sear to be cammed or rotated downwardly away from the cocking piece, thus allowing the firing pin to move forward and strike the primer.

As previously stated, if it is desired to remove the bolt from the pistol, continued pulling of the trigger causes the sear release 62 to pull down the bolt release plunger 80 to release the bolt.

In the trigger mechanism, as described, there is not a pull rod between the trigger and the sear release. In the action as described, if the pistol should be dropped on its muzzle, the connector or link 42 cannot move forward by inertia or in any direction that would allow the pistol to be accidentally fired inasmuch as the connector or link 42 is pivoted at 43. There is no part that can move forward by inertia, causing accidental firing.

The sear release 62 is proportioned such that the greater part of its mass is behind the pivot end 63, that is, rearwardly of it. In the event the pistol should be dropped on its butt, inertia causes the sear release 62 to be rotated into (toward) the sear, preventing the sear from being cammed down by the cocking piece as a result of inertia forces. Thus, safety is realized in that the pistol will not fire if dropped on its butt. The sear spring 75, which is between the sear 74 and the sear release 62 acts on both to urge both of them to safe positions, and it adds its mass to that of the sear release to be rotated into the safe position.

The claims appended hereto are directed to the improved combination, and they particularly point out the particular improvement of the invention. The claims are intended to cover the preferred form of the invention as disclosed herein, as well as a reasonable range of equivalents, having reference to the combination as well as to individual elements. The actual shape or design of individual elements, such as the sear, sear release, trigger and connector member, might vary considerably within the scope and coverage of the invention, as long as these elements perform and cooperate with each other in the manner described for the preferred embodiment and the best mode of practice of the invention, as identified in the foregoing in the Description of the Invention and of the Operation.

From the foregoing, those skilled in the art will readily understand the nature and construction of the invention and the manner in which it achieves and realizes all of the objects and advantages set forth in the foregoing.

The foregoing disclosure is representative of a preferred form of the invention and is to be interpreted in an illustrative rather than a limiting sense, the invention to be afforded the full scope of the claims appended hereto.

We claim:

1. In a firearm, in combination, a trigger mechanism, a trigger positioned forwardly of the trigger mechanism, the trigger mechanism including a sear, sear actuating means including an elongated connector member, the connector member having a pivotal mounting at an intermediate position of the connector member whereby the connector member is restrained from movement along its length, the trigger being positioned to act on the connector member and to move it angularly, and means whereby a part of the connector member actuates the sear for firing by angular movement about its pivotal mounting.

2. A combination as in claim 1 wherein the sear, and the actuating means including the said connector member, are mounted whereby inertia forces resulting from dropping cannot cause actuation of the sear for firing.

3. A combination as in claim 1, including a pivotally mounted sear release member positioned to engage the sear and having a part engageable by the connector member, whereby the connector member can actuate the sear release member for releasing the sear.

4. A combination as in claim 3 wherein the sear release member is proportioned relative to its pivotal mounting, such that inertia forces acting transversely with respect to the sear release member having a component tending to rotate the sear release member urge the sear in sear holding direction.

5. A combination as in claim 4 including a sear spring positioned between the sear and the sear release member urging both the sear and sear release member in a non-firing direction.

6. In a firearm, in combination, a trigger mechanism, a trigger positioned forwardly of the trigger mechanism, the trigger mechanism including a sear, sear actuating means including a connector member, the connector member having a pivotal mounting at an intermediate position of the connector member, the trigger being positioned to act on the connector member and to move it angularly, and means whereby a part of the connector member actuates the sear for firing, a pivotally-mounted sear release member positioned to engage the sear and having a part engageable by the connector member, whereby the connector member can actuate the sear release member for releasing the sear, a bolt release plunger positioned in the action for axial movement in a bolt releasing direction, said plunger having engagement with the sear release member, whereby it can be actuated by trigger pull.

7. In a firearm, in combination, a trigger mechanism, a trigger positioned to operate the trigger mechanism, the trigger mechanism including a sear, a pivotally mounted sear release member positioned to engage the sear and operative to release the sear, a sear spring positioned between the sear and the sear release member whereby both the sear and the sear release member are urged in non-firing direction.

8. A firearm as in claim 7 wherein a major portion of the mass of the sear release member is positioned on one side of its pivot, whereby a transverse inertia force having a component acting on the sear release member to rotate it will urge it in a direction to hold the sear in non-firing position.

9. In a firearm, in combination, a trigger mechanism, a trigger positioned to operate the trigger mechanism, the trigger mechanism including a sear, a pivotally mounted sear release member positioned to engage the sear and operative to release the sear, a major part of the mass of the sear release member being on one side of its pivot, the sear release member having a position whereby transverse inertia forces having a component acting on it to rotate it will move it in a direction to hold rather than release the sear.

10. A firearm as in claim 9 including a connector member having a pivotal mounting at an intermediate position thereof, the trigger being positioned to act on the connector member to move it angularly and means whereby a part of the connector member actuates the sear release member for releasing the sear.

11. A firearm as in claim 10, including a spring positioned between the sear release member and the sear, and the spring engaging the sear release member and the sear in position whereby to bias both the sear release member and the sear toward a non-firing position.

* * * * *